United States Patent [19]

Smith

[11] Patent Number: 4,608,110

[45] Date of Patent: Aug. 26, 1986

[54] PRESSURE SENSITIVE LABEL DISPENSER

[76] Inventor: Ward C. Smith, 16 Judith Ann Ct., Mahwah, NJ 07430

[21] Appl. No.: 702,809

[22] Filed: Feb. 19, 1985

[51] Int. Cl.[4] ..... B32B 31/04

[52] U.S. Cl. ..... 156/250; 156/256; 156/523; 156/527; 156/577; 156/579

[58] Field of Search ..... 156/250, 256, 517, 521, 156/523, 528, 538, 540, 541, 542, 571, 579, 527

[56] References Cited

U.S. PATENT DOCUMENTS

| | | | |
|---|---|---|---|
| 3,540,969 | 11/1970 | Jorgensen | 156/523 |
| 3,709,761 | 1/1973 | Trueb et al. | 156/523 |
| 3,745,086 | 7/1973 | Parker | 156/577 |
| 3,930,927 | 1/1976 | Thompson et al. | 156/577 |
| 4,486,263 | 12/1984 | Gomez | 156/523 |

*Primary Examiner*—Caleb Weston

[57] ABSTRACT

An apparatus is disclosed for dispensing discrete lengths of adhesive tape onto a substrate. A take-off reel is rotatably mounted in a housing having an opening through which tape is dispensed. A supply reel, a curved flat spring guide, a tape cutting blade and a dispenser mechanism are all located within the take-off reel. The guide reverses the direction of the tape from the supply reel and presses the adhesive side thereof against the inner surface of the take-off reel. A detent mechanism resists the rotation of the take-off reel after predetermined angular rotations thereof. When properly indexed, the take-off reel is rotated one detent position to properly align the tape with respect to the blade. The blade is actuated to cut from the tape a discrete label which can be dispensed.

32 Claims, 9 Drawing Figures

PRESSURE SENSITIVE LABEL DISPENSER

BACKGROUND OF INVENTION

This invention relates to tape applicating devices and in particular, to devices for applying short lengths of single ply, pressure sensitive adhesive tape to a substrate.

Pressure sensitive tape having preprinted labels and decorations of discrete length is presently available. Such tape may have a uniform thickness throughout its length or it may be such that the labels are die cut in geometric shapes (circles, ellipses, stars, etc.) having a reduced cross-section attachment between the geometric shapes. Several applicators have been developed for dispensing such discrete, pre-cut lengths of tape. They have been commercially unsuccessful because they are complex, desk top models which do not meet the need for a portable, hand held dispenser.

U.S. Pat. No. 3,930,927 (Thompson et al.) teaches an apparatus for dispensing discrete lengths of double-coated adhesive tape onto a substrate. A take-off drum with a plurality of flat applicating surfaces disposed about its circumference is rotatably mounted inside a housing at one end thereof. The supply roll is mounted at the other end of the housing, the tape being pulled off the supply roll by the take-off drum as the drum rotates. The tape is cut to a discrete length on the drum and is then transferred to a substrate to which it more readily adheres. The Thompson et al. apparatus is typical of prior art applicators in which the supply reel and the take-off reel are disposed in a side-by-side relationship, requiring the tape to be attached to the outside periphery of the take-off reel. Other applicators which utilize the adhesive side of the tape in attachment to a take-off reel to remove tape from the supply reel employ various kinds of take-off reels and tape guides. For example, see U.S. Pat. Nos. 2,274,623, Re. 22,945 and 2,509,641.

SUMMARY OF THE INVENTION

It is an object of this invention to provide a simple to use, inexpensive hand held dispenser of discrete sections of adhesive tape. Another object is to provide a dispenser of the aforementioned type which can be easily assembled and operated.

The applicator of the present invention comprises an apparatus for dispensing short discrete lengths of adhesive tape onto a substrate. The applicator is of the type including means for supporting a supply reel and take-off reel means on which tape from the supply reel is temporarily adhered prior to being dispensed. The device is characterized in that the tape supply reel supporting means is located within the take-off reel.

In one embodiment, tape guide means such as a curved flat spring between the supply reel and the take-off reel reverses the direction of the tape and presses the adhesive side of the tape against the inner surface of the take-off reel. The applicator may include means for cutting the tape into discrete lengths or labels and means for pressing the label against a receiving surface. The aforementioned components may be located within a housing having an opening through which the label is dispensed. Detent means resists rotations of the take-off reel after predetermined angular rotations thereof.

The housing may have a flexible region which bears against the take-off reel when pressure is applied thereto. The present invention also involves a method of indexing the tape so that a cut registration between adjacent labels can be aligned with the cutting means. Pressure is applied to the flexible region to prevent rotation of the take-off reel. In addition, the spring guide may be disengaged so that it ceases to force the tape against the take-off reel during the time that the tape is pulled through the opening. The tape is pulled through the opening and along the housing until the cut registration becomes aligned with a predetermined registration mark on the housing. The housing is then released to permit the take-off reel to rotate freely. The tape is then properly indexed and can be dispensed.

DESCRIPTION OF THE PREFERRED EMBODIMENT

Figure 1:
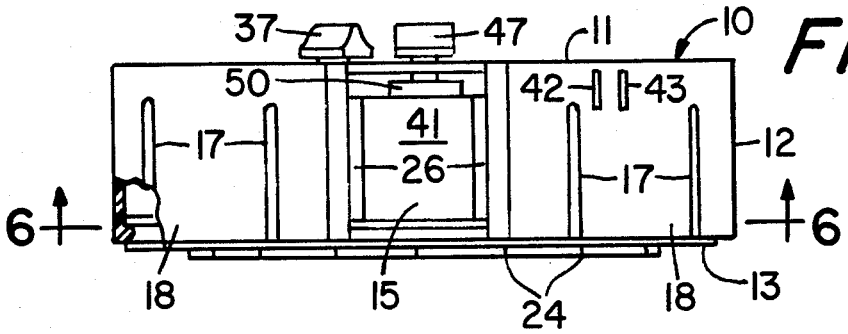
FIG. 1 is a front elevation of one embodiment of this invention.
Figure 2:
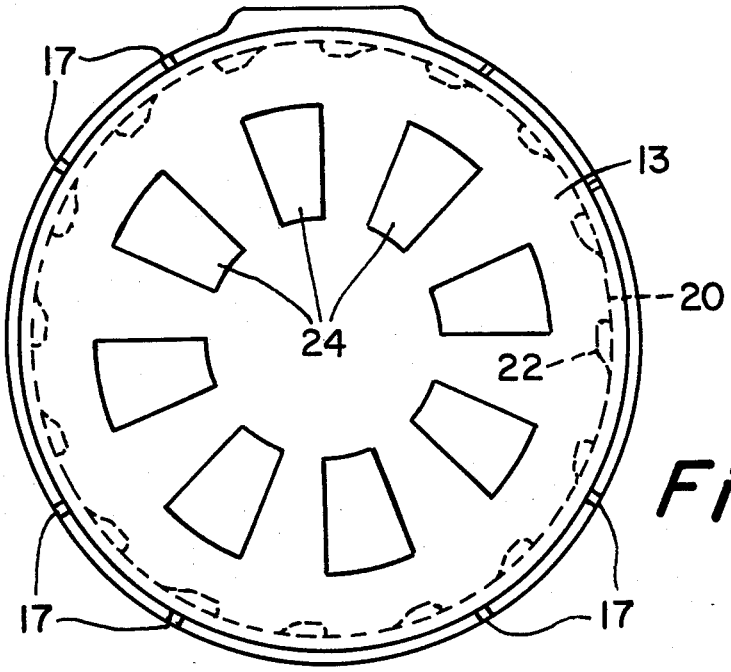
FIG. 2 is a bottom view of the apparatus shown in FIG. 1.
Figure 3:
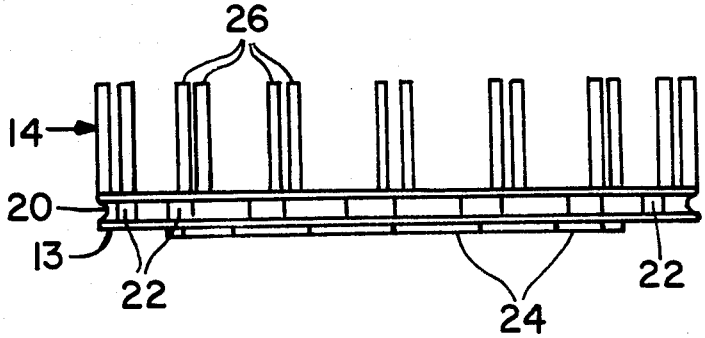
FIG. 3 is a front elevation of the take-off reel employed in the embodiment of FIG. 1.

Generally, the tape dispenser and applicator of the present invention comprises a circular housing 10 having a base portion 11 and skirt 12. Forming the remaining side of the enclosure in which the dispenser apparatus is enclosed is the plate 13 of the take-off reel 14. One side of skirt 12 has an opening 15 through which tape is dispensed. Housing 10 is provided with a plurality of slots 17 resulting in the formation of four skirt sections 18 that can move inwardly and outwardly with respect to the remainder of skirt 12. Those edges of sections 18 remote from base portion 11 are provided with inwardly projecting protrusions or ring segments 19 that engage slot 20 to secure take-off reel plate 13 to the periphery of skirt 12. Slots 17 permit a desired amount of spring action to be developed, whereby ring segments 19 spring outwardly to allow plate 13 to be attached, the ring segments thereafter bearing against slot 20 with sufficient force to retain plate 13. The use of a segmented ring reduces the amount of force required to detach reel 14 from housing 10. One or more detent projections 21 becomes seated in detent slots 22 after a predetermined angular rotation of plate 13. The take-off plate 13 includes a radial pattern of raised surface portions 24 which can be grasped by the fingers to turn the plate while housing 10 is held in the other hand. On the opposite side of plate 13, at the periphery thereof, is a series of paired posts 26 that are spaced equi-distant around the plate. The free ends of the posts may be optionally tied together with a ring (not shown) for increased strength. The distance between adjacent pairs of posts determine the length of tape to be dispensed.

The two posts of each pair of posts provided a rigid backing for the tape during the cutting operation, the cutting knife passing between the two posts of the pair.

Figure 7:
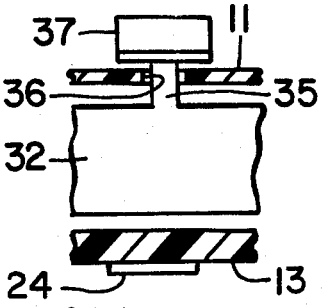
FIG. 7 is a partial sectional view of the embodiment of FIG. 1 illustrating the external connection to the tape guide spring.

Supply reel 29 is mounted on a journal 30 which is offset with respect to the center of take-off reel 14, thus providing room for a tape guide, a cutter and a dispensing head. Tape guide 32, which is a curved flat spring of more or less rectangular cross-section, is attached at one end to a stake 33 which is affixed to housing base 11. In a preferred design, the trailing end of spring guide 32 forms knife 34. As shown in FIG. 7, guide 32 is provided with a projection 35 which extends through slot 36 in housing base portion 11. A handle 37 affixed to projection 35 enables an operator to move projection 35 back and forth in slot 36. Guide spring 32 can thus be moved in one direction for cutting and in the opposite direction for displacing it from paired posts 26, operations which will be hereinafter described in greater detail.

To load the dispenser the take-off reel is released by inserting an object such as a pencil through opening 39 in the center of journal 30 and pushing to cause ring segments 19 to be forced outwardly from groove 20. A cylindrical release button could be permanently disposed within opening 39 for this purpose. Supply reel 29 is placed on journal 30, and the free end of the tape is fed around guide spring 32. At this time handle 37 is moved radially inwardly along housing portion 11 to retract spring 32 from the inner surface of skirt 12. The free end 40 of the tape is passed through opening 15 and is temporarily attached to the housing. While the guide spring is being held back, the take-off reel is snapped into place. Handle 37 is released to allow guide spring 32 to urge tape 40 against posts 26. Guide 32 reverses the direction of the tape so that the adhesive side faces outwardly and is pressed against the take-off reel posts.

The take-off reel is indexed relative to the housing by one or more detent mechanisms. When detent projections 21 are seated in the respective ones of slots 22, cutting blade 34 is positioned between a pair of posts 26.

In the event that the adhesive tape is a reel of preprinted labels, registration of the tape relative to the housing is required. Housing 10 is grasped at one or more of its sections 18 which are provided with detent projections, and a squeezing pressure is applied, thereby holding take-off reel 14 rigid in the housing. Simultaneously, handle 37 is moved along slot 36 to disengage guide spring 32 from posts 26. The tape can then be pulled loose from adhesive contact with the posts of the take-off reel. The tape is pulled through housing opening 15 until the cut registration on the tape is positioned at an indexing indicator mark 43 on the housing. Handle 37 is released, and spring guide 32 moves outwardly against posts 26, thereby pulling a short length of tape 40 back into the housing. The cut registration on the tape should then become aligned with the final registration mark 42 on the side of the housing.

The tape is then in proper registration with respect to the take-off reel posts. Handle 37 is slid radially outwardly along slot 36, and knife 34 cuts the tape. The reel is again indexed, and the tape is cut. The cut length of tape constitutes a label 41 which is ready to be dispensed. The free ends of label 41 are attached to the inner posts of two adjacent pairs of posts. These inner posts are on opposite sides of opening 15, label 41 being centrally located behind the opening.

Figure 8:
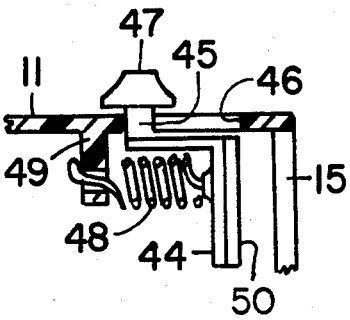
FIG. 8 is a partial sectional view of the embodiment of FIG. 1 illustrating the external connection to the tape dispensing head.
Figure 9:
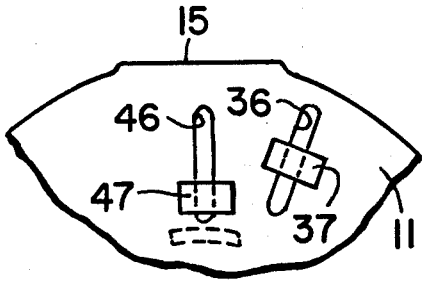
FIG. 9 is a fragmentary top view of the apparatus of FIG. 1.
Figure 4:
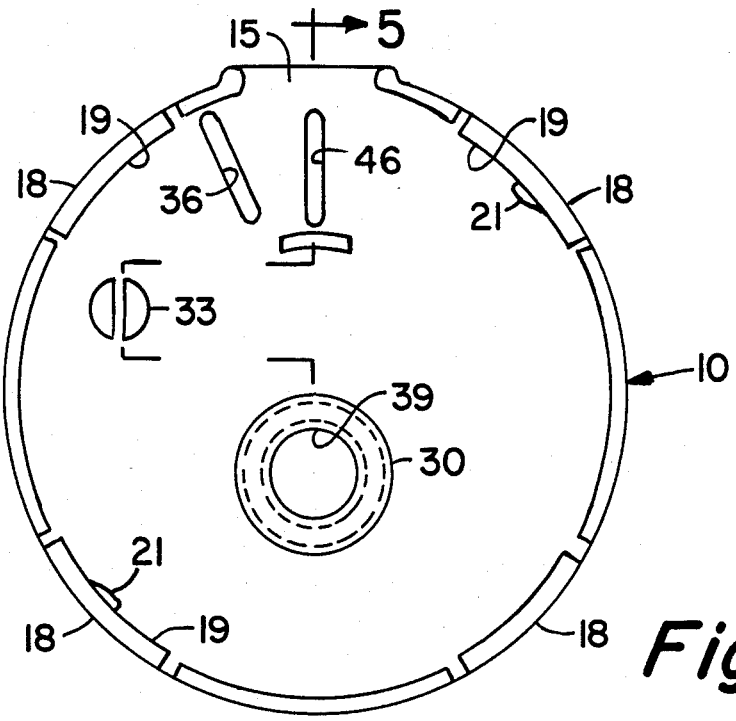
FIG. 4 shows the inside of the housing that is employed in the embodiment of FIG. 1.
Figure 5:
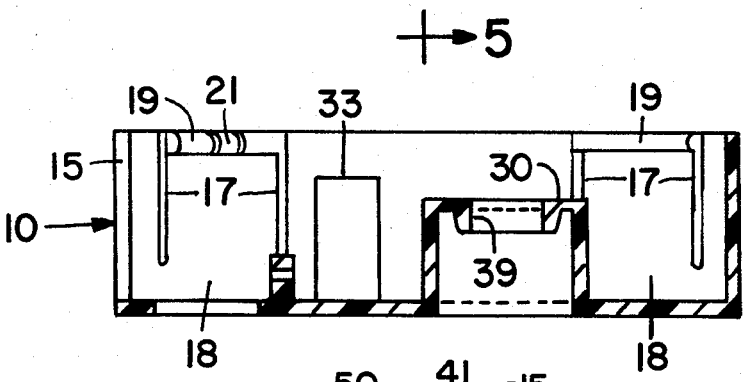
FIG. 5 is a sectional view taken along lines 5—5 of FIG. 4.
Figure 6:
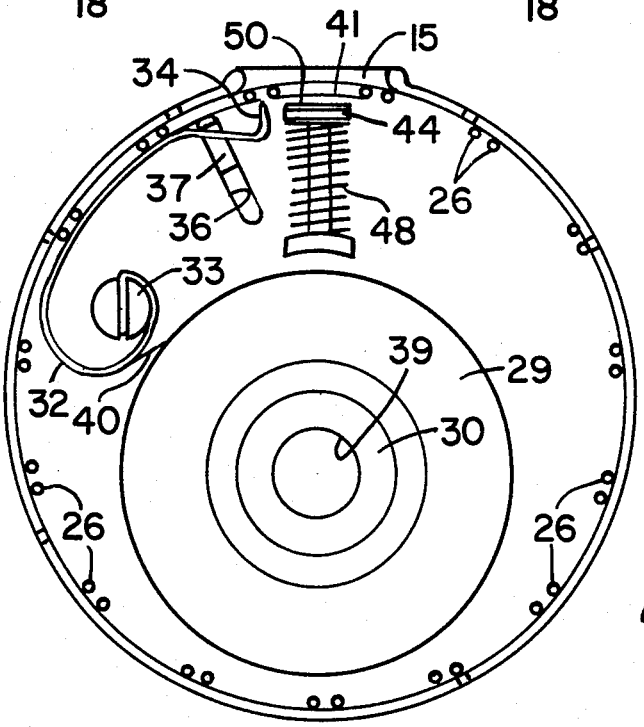
FIG. 6 is a sectional view taken along lines 6—6 of FIG. 1.

Tape dispensing head 44 is slidably attached to the housing. A projection 45 at the top of the head protrudes through a slot 46 in the housing surface and receives a handle 47. Spring 48, which is connected between head 44 and stake 49, biases head 44 in a withdrawn position as shown in FIG. 8. By pressing handle 47 toward opening 15, dispensing head 44 moves outwardly, thereby pushing label 41 from the posts to a receiving surface. When handle 47 is released, the dispensing head returns to its withdrawn position. The housing may be designed to rest on the receiving surface with sufficient space between the surface and the posts to permit the label to be pushed out of contact with the posts as it makes contact with the receiving surface. Alternatively, by withdrawing the dispenser from the receiving surface, the label will be pulled from the posts. A compressible surface on the dispensing head, such as foam layer 50, will allow the tape to be pressed onto curved surfaces such as those of test tubes. By contouring the compressible surface, the label can be pressed in the center first to avoid wrinkles.

The length of cut tape is fixed by the distance between pairs of posts. The preferred length for a hand held dispenser is about 0.75 inch when utilizing a standard 2.5 inch diameter tape supply roll. Significantly longer labels would require much larger take-off reels, which would indicate a "bench" or "table" model.

In the process of printing consecutive labels on a long length of tape, there is the real possibility of tolerance drift. After dispensing many labels, it may be necessary to re-index the tape. This can be done by grasping the housing at the previously indicated position which locks the motion of the take-off reel relative to the housing, pulling the tape through the window at an angle which releases the tape from the posts by forcing the tape guide spring to give way. The tape can then be registered against an index mark of the housing. At this point, by cutting the tape with the tape cutter, the tape guide spring will reseat the tape at the proper index position. This is essentially the same procedure as used when loading a new reel of tape.

Whereas a preferred embodiment of the present invention has been shown and described herein, various modifications thereof come within the scope of the invention. Whereas the tape guide has been illustrated as being a spring, it could also be a roller, a combination of a spring and roller, or the like. Also, the take-off reel may be attached to the housing in any of several ways other than that described above. One way is by use of a split shaft which would snap through a bore located in the supply reel journal, the bore being eccentric to the journal centerline. The split shaft would protrude into a recess in the outside surface of the housing formed by the hollow supply reel journal.

I claim:

1. An applicator for dispensing adhesive tape onto a receiving surface, said applicator being of the type including means supporting a tape supply reel, and take-off reel means on which tape from said supply reel is temporarily adhered prior to being dispensed, said applicator being characterized in that said means supporting said tape supply reel is located within said take-off reel.

2. An applicator in accordance with claim 1 further comprising tape guide means between said tape reel support means and said take-off reel means for reversing the direction of said tape and pressing said tape against the inner surface of said take-off reel.

3. An applicator in accordance with claim 2 further comprising means positioned within said take-off reel for cutting said tape.

4. An applicator in accordance with claim 3 wherein said means for reversing direction of said tape is a curved flat spring and said tape cutting means is an extension of said spring.

5. An applicator in accordance with claim 4 further comprising means for dispensing a cut length of tape against a receiving surface.

6. An applicator in accordance with claim 5 wherein said take-off reel comprises a disc-shaped rotatable plate having a plurality of pairs of posts equidistantly spaced around the periphery thereof, said posts being parallel to the axis of rotation of said plate.

7. An applicator in accordance with claim 6 further comprising detent means connected to said take-off reel for tending to stop rotation thereof at predetermined angular orientations, said cutting means being located adjacent a pair of posts when said plate is in a detented angular position.

8. An applicator in accordance with claim 1 further comprising means positioned within said take-off reel for cutting said tape.

9. An applicator in accordance with claim 1 further comprising means for dispensing a cut length of tape against a receiving surface.

10. An applicator for dispensing adhesive tape onto a receiving surface, said applicator comprising a housing, take-off reel means rotatably attached to said housing for temporarily contacting and supporting said adhesive tape prior to the time that said tape is dispensed onto a substrate, and means supporting a tape supply reel within said take-off reel means.

11. An applicator in accordance with claim 10 further comprising tape guide means between said tape supply reel support means and said take-off reel means for reversing the direction of said tape and pressing said tape against the inner surface of said take-off reel.

12. An applicator in accordance with claim 11 further comprising cutting means slidably attached to said housing within said take-off reel for cutting said tape.

13. An applicator in accordance with claim 12 wherein said means for reversing direction is a curved flat spring attached at one end to said housing, the remaining end thereof constituting said cutting means.

14. An applicator in accordance with claim 13 further comprising tape dispensing means slidable attached to said housing within said take-off reel for dispensing sections of cut tape against a receiving surface.

15. An applicator in accordance with claim 14 further comprising means for indexing said housing relative to said take-off reel.

16. An apparatus in accordance with claim 15 wherein said take-off reel comprises a disc-shaped, rotatable plate having a plurality of pairs of posts equidistantly spaced around the periphery thereof, said posts being parallel to the axis of rotation of said plate, said leaf spring pressing said tape against said posts.

17. An apparatus in accordance with claim 16 further comprising means for retracting said flat spring from said posts.

18. An apparatus in accordance with claim 17 wherein said cutting means is located adjacent a pair of posts when said plate is in a detented angular position with respect to said housing.

19. An apparatus in accordance with claim 10 further comprising cutting means slidably attached to said housing within said take-off reel for cutting said tape.

20. An applicator in accordance with claim 10 further comprising tape dispensing means slidably attached to said housing within said take-off reel for dispensing sections of cut tape against a receiving surface.

21. An applicator in accordance with claim 20 further comprising a handle located external to said housing and connected to said tape dispensing means, and spring means connected to said tape dispensing means for moving said dispensing means to a retracted position.

22. An applicator in accordance with claim 10 wherein said take-off reel rotates about an axis that is centrally located within said housing and said means supporting a tape supply reel is not centrally located in said housing.

23. An applicator in accordance with claim 10 further comprising means for indexing said housing relative to said take-off reel.

24. An applicator in accordance with claim 10 wherein said housing has an opening, said applicator further comprising tape dispensing means for dispensing sections of tape through said opening.

25. An applicator in accordance with claim 24 wherein said dispensing means comprises a tape dispensing head slidably mounted within said housing, said head being movable from a position outside said opening to said retracted position, and handle means located external to said housing for moving said dispensing means.

26. An applicator in accordance with claim 25 further comprising a compressible pad attached to said head.

27. An applicator in accordance with claim 10 wherein said take-off reel has at least one internal surface having a sufficient area of contact that said tape is removed from a supply reel by rotation of said internal surface relative to said supply reel.

28. An applicator in accordance with claim 27 wherein said at least one internal surface comprises a plurality of pairs of posts that are spaced equidistant about said take-off reel.

29. An applicator in accordance with claim 10 further comprising gripping means for facilitating rotation of said take-off reel.

30. An applicator in accordance with claim 10 wherein said housing comprises a circular base portion having an annular skirt attached to the periphery thereof, said take-off reel comprising a circular plate that is rotatably mounted in that edge of said skirt that is remote from said base portion, one of said skirt and said plate having at least one detent projection, the remaining of said skirt and said plate having at least one detent slot for mating with said at least one projection.

31. A method of indexing a roll of labels in an applicator of the type comprising a housing, a take-off reel rotatably attached to said housing, a supply reel located within said take-off reel, a blade for cutting discrete labels from said supply reel, an opening in said housing from which said labels are dispensed, and detent means for resisting the rotation of said take-off reel after predetermined angular rotations thereof, said housing having at least one flexible region which bears against said take-off reel when pressure is applied thereto, said method comprising applying pressure to said at least one flexible region to prevent rotation of said take-off reel, pulling said tape through said opening and along said housing until a cut registration between two adjacent labels on the tape becomes aligned with a predetermined registration mark on said housing, and releasing said housing to permit said take-off reel to rotate freely.

32. A method in accordance with claim 31 wherein said applicator further comprises a spring guide which reverses the direction of the tape so that the adhesive side thereof faces outwardly and presses against the inner surface of said take-off reel, said method further comprising the step of disengaging said spring guide so that it ceases to force said tape against said take-off reel during the time that said tape is pulled through said opening.

* * * * *